US005195276A

United States Patent [19]

Vennerholm

[11] Patent Number: 5,195,276

[45] Date of Patent: Mar. 23, 1993

[54] APPARATUS AND METHOD FOR FLUSHING A CASTING

[75] Inventor: John R. Vennerholm, Spruce Pine, N.C.

[73] Assignee: Outboard Marine Corporation, Waukegan, Ill.

[21] Appl. No.: 657,658

[22] Filed: Feb. 15, 1991

[51] Int. Cl.[5] ..... B24C 1/00; B24C 3/32

[52] U.S. Cl. ..... 51/320; 51/319; 51/411; 51/425; 210/136; 210/167; 210/446; 134/7; 134/8

[58] Field of Search ..... 51/317, 319-321, 51/411, 424, 425, 428, 436, 263, 264; 210/167, 136, 446; 209/273; 134/7-8, 22.1, 22.11, 22.12, 22.18, 166 R, 166 C

[56] References Cited

U.S. PATENT DOCUMENTS

| | | | |
|---|---|---|---|
| 2,667,014 | 6/1954 | Gladfelter et al. . | |
| 3,103,765 | 9/1963 | Nolan . | |
| 3,193,975 | 7/1965 | Millhiser | 51/410 |
| 3,455,062 | 7/1969 | Eppler | 51/425 |
| 3,553,895 | 1/1971 | Power | 51/436 X |
| 3,869,830 | 3/1975 | Baker | 51/411 |
| 4,001,976 | 1/1977 | MacMillan . | |
| 4,250,024 | 2/1981 | Soares et al. | 209/273 X |
| 4,872,975 | 10/1989 | Benson . | |

*Primary Examiner*—Bruce M. Kisliuk
*Assistant Examiner*—John A. Marlott
*Attorney, Agent, or Firm*—Michael, Best & Friedrich

[57] ABSTRACT

An apparatus for flushing a workpiece including a passageway having an inlet and an outlet, the apparatus comprising structure adapted to communicate with the inlet and with the outlet for circulating only a fluid through a fluid flow loop including the workpiece passageway, and structure located downstream of the outlet and upstream of the inlet for removing from the fluid substantially all relatively large particles flushed from the passageway and for allowing relatively small particles flushed from the passageway to remain in the fluid so that the relatively small particles are recirculated through the passageway to act as the sole cleaning medium other than the fluid.

20 Claims, 1 Drawing Sheet

APPARATUS AND METHOD FOR FLUSHING A CASTING

BACKGROUND OF THE INVENTION

The invention relates to apparatus for flushing or cleaning castings.

It is known to use a mixture of water and an abrasive material for flushing or scouring a passageway in a casting in order to remove coating material such as sand and clay from the casting. If the casting is shot blasted after the casting process, it is often important that any residual shot be removed from the passageway.

Attention is directed to the following U.S. patents:

| | | |
|---|---|---|
| Gladfelter, et al. | 2,667,014 | Jan. 26, 1954 |
| Nolan | 3,103,765 | Sept. 17, 1963 |
| MacMillan | 4,011,976 | Jan. 11, 1977 |
| Benson | 4,872,975 | Oct. 10, 1989 |

SUMMARY OF THE INVENTION

The invention provides an apparatus for flushing a workpiece including a passageway having an inlet and an outlet, the apparatus comprising a mechanism adapted to communicate with the inlet and with the outlet for circulating a fluid through a fluid flow loop including the workpiece passageway, and a mechanism located downstream of the outlet and upstream of the inlet for removing from the fluid substantially all relatively large particles flushed from the passageway and for allowing relatively small particles flushed from the passageway to remain in the fluid so that the relatively small particles are recirculated through the passageway to act as the sole cleaning medium other than the fluid.

One embodiment of the invention provides a method for flushing a workpiece including a passageway having an inlet and an outlet, the method comprising the steps of circulating a liquid through the passageway so as to flush particles from the passageway, and using only particles flushed from the passageway as a scouring agent entrained in the liquid for further cleaning the passageway.

One embodiment of the invention provides a method for flushing a workpiece including a passageway having an inlet and an outlet, the method comprising the steps of introducing a fluid containing substantially no solids into the passageway inlet, removing from fluid discharged from the passageway outlet substantially all relatively large particles and allowing relatively small particles flushed from the passageway to remain in the fluid, and reintroducing the fluid into the passageway inlet so that the relatively small particles pass through the passageway and are substantially the only solids in the fluid.

One embodiment of the invention provides an apparatus for flushing a workpiece including a passageway having an inlet and an outlet, the apparatus comprising a mechanism adapted to communicate with the inlet and with the outlet for circulating a fluid through a fluid flow loop including the workpiece passageway, a mechanism located downstream of the outlet and upstream of the inlet for removing from the fluid substantially all relatively large particles flushed from the passageway and for allowing relatively small particles flushed from the passageway to remain in the fluid so that the relatively small particles are recirculated through the passageway to act as the sole cleaning medium other than the fluid, the removing mechanism including a settling chamber having an inlet adapted to communicate with the passageway outlet and having an outlet, a pump having an inlet communicating with the settling chamber outlet and having an outlet, a conduit having an inlet communicating with the pump outlet and having an outlet adapted to communicate with the passageway inlet, and a filter located in the chamber outlet, a source of compressed air communicating with the conduit downstream of the pump outlet and upstream of the passageway inlet, and a mechanism for sealingly connecting the workpiece to the conduit with the conduit outlet in communication with the workpiece inlet and for supporting the workpiece relative to the settling chamber with the workpiece outlet communicating with the chamber inlet.

A principal feature of the invention is the provision of a method and an apparatus that use relatively small particles (such as sand and clay particles) flushed from a casting passageway as the sole scouring agent in water recirculated through the casting. Thus, no solids are introduced into the water before the water enters the passageway. Small particles flushed from the casting remain in the water and help to clean the passageway when the water is recirculated through the casting. Relatively large particles, such as residual shot, are removed from the water before the water is recirculated through the passageway.

Other features and advantages of the invention will become apparent to one skilled in the art upon review of the following detailed description, claims and drawings.

Figure 1:
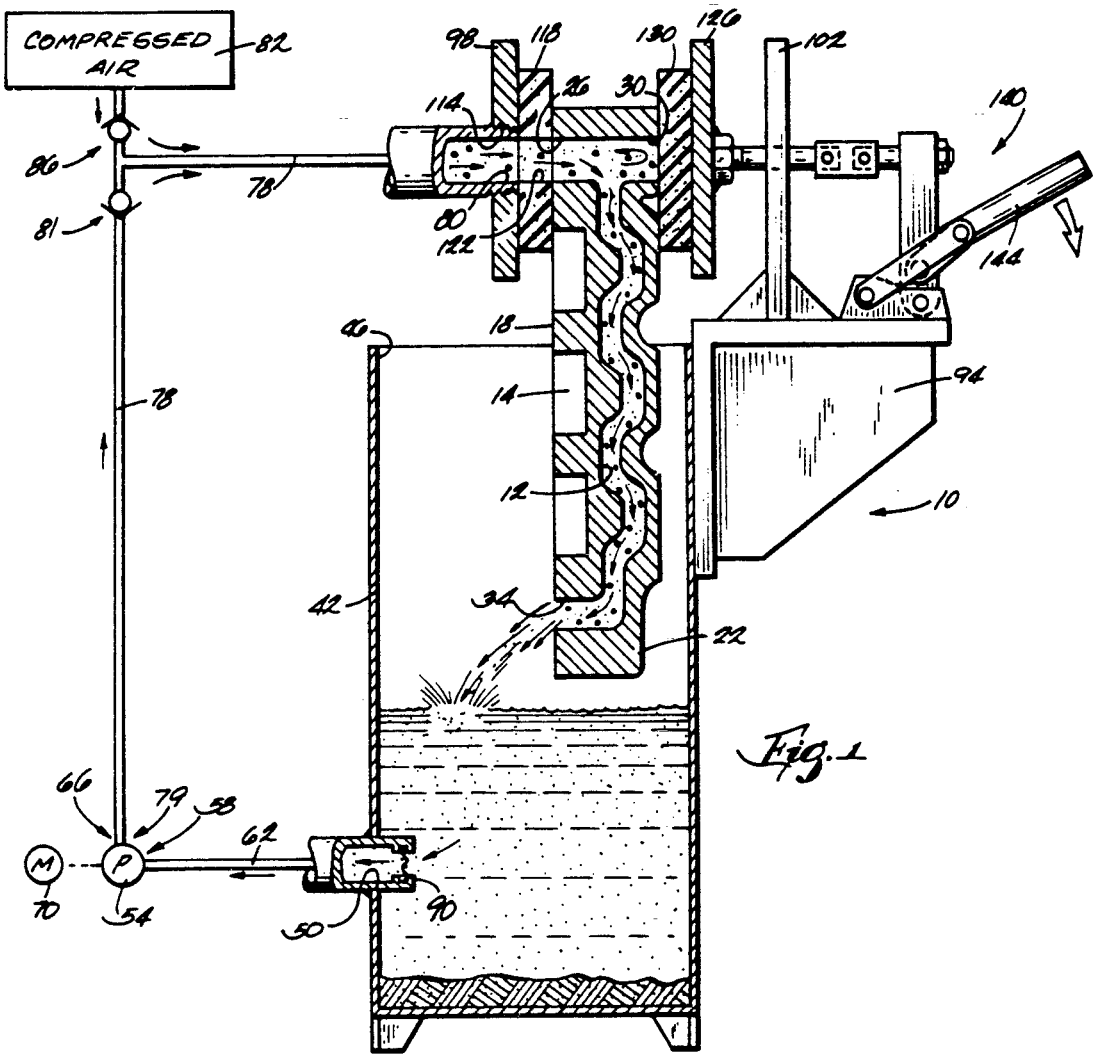
FIG. 1 is a side elevational view of an apparatus embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

An apparatus 10 embodying the invention is illustrated in the drawings. The apparatus 10 is used to flush a passageway 12 in a workpiece such as a casting 14 formed, for example, in a lost foam casting process. The casting 14 is preferably shot blasted before being flushed by the apparatus 10. While the illustrated casting 14 is a cylinder head, it should be understood that the apparatus 10 can be used to flush any type of casting. Also, the apparatus 10 can be used to flush other types of workpieces.

In the illustrated construction, the casting 14 has left and right outer surfaces 18 and 22, respectively, and the passageway 12 includes an inlet 26 in the left surface 18, an inlet 30 in the right surface 22, and an outlet 34 in the left surface 18. The apparatus 10 comprises means communicating with the inlet 26 and with the outlet 34 for circulating a fluid through a fluid flow loop including the casting passageway 12. In the preferred embodiment, the fluid includes both water and a gas such as compressed air. The compressed air creates turbulence in the water. While various suitable circulating means can be employed, in the illustrated construction, the circulating means includes a settling tank 42, which is preferably a conventional 55-gallon drum. The drum 42 has an open upper end defining an inlet 46 communicating with the passageway outlet 34, and the drum 42 also has an outlet 50 communicating with the passageway inlet 26 in a manner described below.

The circulating means also includes a pump 54 having an inlet 58 communicating with the drum outlet 50 via a conduit 62. The pump 54 also has an outlet 66 communicating with the passageway inlet 26 in a manner described below. The pump 54 is preferably a conventional flooded suction pump driven by a motor 70. The circulating means also includes a conduit 78 having an inlet 79 communicating with the pump outlet 66 and having an outlet 80 communicating with the passageway inlet 26. The conduit 78 preferably has therein a one-way valve 81 that prevents fluid flow toward the pump outlet 66.

The apparatus 10 also comprises a source 82 of compressed air communicating with the conduit 78 downstream of the pump outlet 66 and upstream of the passageway inlet 26. In the illustrated construction, the compressed air source 82 communicates with the conduit 78 downstream of the valve 81, and a one-way valve 86 prevents fluid flow from the conduit 78 to the compressed air source 82. The air is thus introduced into the water in the conduit 78 at a pressure substantially greater than atmospheric pressure, and preferably at approximately 80 psi. In alternative embodiments, the air can be pulsating in order to create additional turbulence in the water.

The apparatus 10 also comprises means located downstream of the passageway outlet 34 and upstream of the passageway inlet 26 for removing from the water substantially all relatively large particles flushed from the passageway 12 (e.g., residual shot from the shot blasting process) and for allowing relatively small particles flushed from the passageway 12 (e.g., sand and clay particles) to remain in the water so that the small particles are recirculated through the passageway 12 to act as the sole cleaning medium or scouring agent other than the water and air.

While various suitable removing means can be employed, in the preferred embodiment, the removing means includes the settling tank or drum 42. As shown in FIG. 1, the drum outlet 50 is spaced above the bottom of the drum 42 and is located below the water line in the drum 42. Also, the passageway outlet 34 is located above the water line in the drum 42 so that water and particles discharged from the outlet 34 cascade into the drum 42 in a relatively turbulent manner. While large or heavy particles in the water settle to the bottom of the drum 42, small particles remain in suspension so that such small particles are carried with the water into the conduit 78.

The removing means also includes a filter or filter screen 90 located in the drum 42 between the drum inlet 46 and the drum outlet 50. In the illustrated construction, the filter 90 is located in the inlet of the conduit 62, i.e., between the inlet 46 and the outlet 50 of the drum 42. The filter 90 is constructed so as to allow the small particles to flow through the filter 90 while preventing the large particles from flowing through the filter 90. In the preferred embodiment, the filter 90 prevents the passage of particles having a diameter greater than or equal to 0.020 inches. Thus, large particles that fail to settle to the bottom of the drum 42 are substantially prevented from entering the conduit 78.

Figure 2:
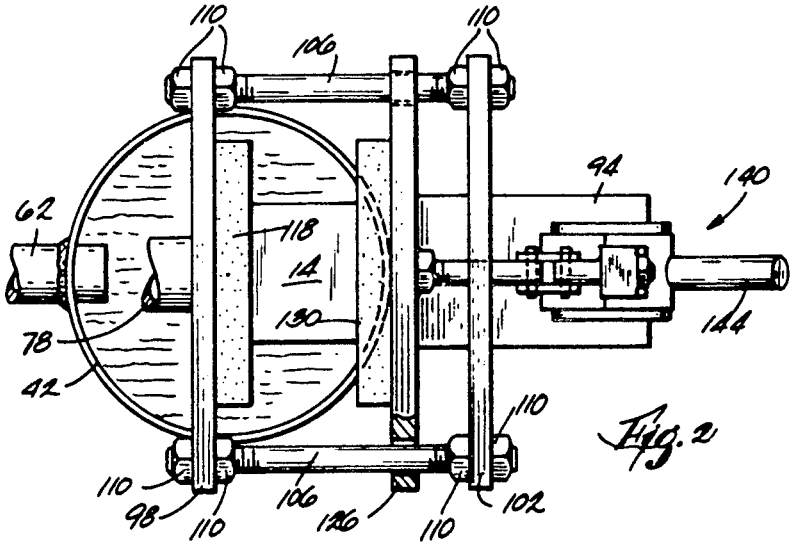
FIG. 2 is a plan view of the apparatus.

The apparatus 10 also comprises means for sealingly connecting the casting 14 to the conduit 78 with the conduit outlet 80 communicating with the casting inlet 26 and for supporting the casting 14 relative to the drum 42 with the casting outlet 34 communicating with the drum inlet 46. While various suitable means can be employed, in the illustrated construction, the connecting and supporting means includes a frame 94 fixed relative to the drum 42, and a pair of generally parallel, spaced left and right plates 98 and 102 supported by the frame 94. As shown in FIGS. 1 and 2, the right plate 102 is fixed to the frame 94, and the left plate 98 is fixed relative to the right plate 102 by a plurality of elongated supporting members 106 which, as shown in FIG. 2, preferably have threaded ends which extend through the plates 98 and 102 and which are secured relative thereto by nuts 110. The left plate 98 has therethrough (see FIG. 1) an internally threaded bore 114 into which the outlet end of the conduit 78 is threaded. A sealing member 118 made of a suitable material such as rubber is mounted on the right or inner surface of the left plate 98 and has therethrough a bore 122 communicating with the conduit outlet 80. The bore 122 in the sealing member 118 also communicates with the passageway inlet 26 when the casting 14 is clampingly engaged as described below. A third or intermediate plate 126 is slidably supported on the elongated members 106 intermediate the left and right plates 98 and 102 and extends generally parallel to the plates 98 and 102. A sealing member 130 similar to the sealing member 118 is supported on the left or inner surface of the intermediate plate 126. The sealing member 130 sealingly closes the right passageway inlet 30 when the casting 14 is clampingly engaged as described below. The intermediate plate 126 is movable relative to the left plate 98 between an engaged position (shown in FIG. 1) wherein the casting 14 can be clampingly engaged between the sealing members 118 and 130 with the passageway inlet 26 communicating with the conduit outlet 80 as shown in FIG. 1, and a disengaged position (not shown) wherein the casting 14 is removable from the connecting and supporting means.

The connecting and supporting means also includes means for moving the intermediate plate 126 between the engaged and disengaged positions. While various suitable moving means can be employed, in the illustrated construction, such means includes a toggle mechanism 140 including a handle 144 movable between an engaged position (shown in FIG. 1) wherein the intermediate plate 126 is in its engaged position, and a disengaged position (not shown) wherein the intermediate plate 126 is in its disengaged position.

When the casting 14 is clampingly engaged between the sealing members 118 and 130 as shown in FIG. 1, the pump 54 causes water flow from the drum 42 through the conduits 62 and 78, through the passageway 12, and back into the drum 42. Compressed air enters the conduit 78 upstream of the casting 14 and flows through the passageway 12 with the water. The compressed air creates turbulence in the water and thereby enhances the cleaning action of the water. The settling chamber 42 and the filter 90 cause substantially all relatively large or heavy particles flushed from the passageway 12 to be removed from the water discharged from the passageway 12. Small particles flushed from the passageway 12 remain in the water. The pump 54 and the conduits 62 and 78 reintroduce the water and additional compressed air into the passageway inlet 26 so that the small particles entrained in the water pass through the passageway 12 and are substantially the only solids in the mixture of water and air. Thus, a fluid containing substantially no solids is initially introduced into the passageway inlet 26, and only particles flushed from the passageway 12 are used as a scouring agent entrained in the water for further cleaning the passageway 12.

Various features of the invention are set forth in the following claims.

I claim:

1. An apparatus for flushing a workpiece including a passageway having an inlet and an outlet, said apparatus comprising means adapted to communicate with the inlet and with the outlet for circulating a fluid through a fluid flow loop including the workpiece passageway, and means located downstream of the outlet and upstream of the inlet for removing from said fluid substantially all relatively large particles flushed from the passageway and for allowing relatively small particles flushed from the passageway to remain in said fluid so that the relatively small particles are recirculated through the passageway to act as the sole cleaning medium other than said fluid.

2. An apparatus as set forth in claim 1 wherein said fluid includes water.

3. An apparatus as set forth in claim 2 wherein said fluid also includes air.

4. An apparatus as set forth in claim 3 wherein said air is introduced into said water at a pressure substantially greater than atmospheric pressure.

5. An apparatus as set forth in claim 4 wherein said air is pulsating.

6. An apparatus as set forth in claim 1 wherein said removing means includes a settling chamber having an inlet adapted to communicate with the passageway outlet and having an outlet adapted to communicate with the passageway inlet.

7. An apparatus as set forth in claim 6 wherein said removing means further includes a pump having an inlet communicating with said settling chamber outlet and having an outlet adapted to communicate with the passageway inlet.

8. An apparatus as set forth in claim 7 wherein said removing means further includes a conduit having an inlet communicating with said pump outlet and having an outlet adapted to communicate with the passageway inlet.

9. An apparatus as set forth in claim 8 and further comprising a source of compressed air communicating with said conduit downstream of said pump outlet and upstream of the passageway inlet.

10. An apparatus as set forth in claim 8 and further comprising means for sealingly connecting the workpiece to said conduit with said conduit outlet in communication with the passageway inlet and for supporting the workpiece relative to said settling chamber with the passageway outlet communicating with said chamber inlet.

11. An apparatus as set forth in claim 10 wherein said connecting and supporting means includes means for clampingly engaging the workpiece.

12. An apparatus as set forth in claim 6 wherein said removing means further includes a filter located in said settling chamber between said chamber outlet and said chamber inlet.

13. An apparatus as set forth in claim 6 wherein said removing means further includes a filter located at said chamber outlet.

14. A method for flushing a workpiece including a passageway having an inlet and an outlet, said method comprising the steps of circulating a liquid through the passageway so as to flush particles from the passageway, and using only particles flushed from the passageway as a scouring agent entrained in said liquid for further cleaning the passageway.

15. A method as set forth in claim 14 and further comprising the step of removing relatively large particles from said liquid so that only relatively small particles act as said scouring agent.

16. A method as set forth in claim 14 and further comprising the step of introducing a gas into said liquid.

17. An apparatus for flushing a workpiece including a passageway having an inlet and an outlet, said apparatus comprising means adapted to communicate with the inlet and with the outlet for circulating a fluid through a fluid flow loop including the workpiece passageway, means located downstream of the outlet and upstream of the inlet for removing from said fluid substantially all relatively large particles flushed from the passageway and for allowing relatively small particles flushed from the passageway to remain in said fluid so that the relatively small particles are recirculated through the passageway to act as the sole cleaning medium other than said fluid, said removing means including a settling chamber having an inlet adapted to communicate with the passageway outlet and having an outlet, a pump having an inlet communicating with said settling chamber outlet and having an outlet, a conduit having an inlet communicating with said pump outlet and having an outlet adapted to communicate with the passageway inlet, and a filter located in said chamber outlet, a source of compressed air communicating with said conduit downstream of said pump outlet and upstream of the passageway inlet, and means for sealingly connecting the workpiece to said conduit with said conduit outlet in communication with the passageway inlet and for supporting the passageway relative to said settling chamber with the workpiece outlet communicating with said chamber inlet.

18. An apparatus as set forth in claim 17 wherein said fluid includes water.

19. An apparatus as set forth in claim 17 wherein said connecting and supporting means includes means for clampingly engaging the workpiece.

20. A method for flushing a workpiece including a passageway having an inlet and an outlet, said method comprising the steps of introducing a fluid containing substantially no solids into the passageway inlet, removing from fluid discharged from the passageway outlet substantially all relatively large particles and allowing relatively small particles flushed from the passageway to remain in said fluid, and reintroducing said fluid into the passageway inlet so that the relatively small particles pass through the passageway and are substantially the only solids in said fluid.

* * * * *